US005326943A

United States Patent [19]

Macaulay

[11] Patent Number: 5,326,943

[45] Date of Patent: Jul. 5, 1994

[54] EXHAUST MUFFLER

[76] Inventor: Neil Macaulay, Unit 19, 19695-96 A Ave., Langley, B.C., V3A 4P8, Canada

[21] Appl. No.: 172,791

[22] Filed: Dec. 27, 1993

[51] Int. Cl.[5] ..... F01N 1/08

[52] U.S. Cl. ..... 181/269; 181/272; 181/282

[58] Field of Search ..... 181/249, 255, 269, 272, 181/282, 265, 268, 275

[56] References Cited

U.S. PATENT DOCUMENTS 3,340,958 9/1967 Conlin ..... 181/269

3,530,953 9/1970 Conlin ..... 181/272

*Primary Examiner*—Michael L. Gellner

*Assistant Examiner*—Khanh Dang

[57] ABSTRACT

A muffler comprising a main body having a downstream end and an upstream end relative to gas flow. There is an inner vessel within the main body to divide the main body into an inner chamber and first and second outer chambers. A resonating chamber within the inner chamber divides the inner chamber into first and second inner chambers. The resonating chamber has a perforate wall on its upstream side. An inlet pipe extends into the upstream end of the main body and terminates in a downstream end communicating with the first outer chamber and the first inner chamber. An outlet pipe extends into the upstream end of the main body and terminates in the second outer chamber and in the second inner chamber. In addition there is an inner pipe communicating the first outer chamber, the first inner chamber and the resonating chamber. The further inner pipe communicates the second outer chamber, the second inner chamber and the resonating chamber.

8 Claims, 1 Drawing Sheet

EXHAUST MUFFLER

FIELD OF THE INVENTION

This invention relates to an exhaust muffler for an engine.

DESCRIPTION OF THE PRIOR ART

A muffler is attached to the exhaust system of a gas or diesel engine in order to decrease or muffle the noise of the engine. The law requires that any road going vehicle be equipped with a muffler as without such a device the noise produced by an internal combustion engine would quickly damage the human ear.

Particularly on trucks mufflers are bulky devices. They are expensive to produce and the welding involved on such a large, relatively complicated structure, is difficult. Applicant has previously obtained U.S. Pat. No. 3,530,953 and Canadian patent 891,829 which relate to mufflers of improved construction. They are relatively lightweight yet efficient.

The present invention provides further improvements on these mufflers.

SUMMARY OF THE INVENTION

Accordingly the present invention is a muffler comprising a main body having a downstream end and an upstream end relative to gas flow; an inner vessel attached to the inner periphery of the main body to divide the interior of the main body into an inner chamber and first and second outer chambers; a resonating chamber within the inner chamber, to divide the inner chamber into first and second inner chambers; the resonating chamber having a perforate wall on its upstream side; an inlet pipe extending into the upstream end of the main body and terminating in a downstream end communicating with the first outer chamber and the first inner chamber; an outlet pipe extending into the upstream end of the main body and terminating in a downstream end communicating with the second outer chamber and a second inner chamber; a first inner pipe communicating the first outer chamber, the first inner chamber, and the resonating chamber; and a second inner pipe communicating the second outer chamber, the second inner chamber and the resonating chamber.

BRIEF DESCRIPTION OF THE DRAWINGS

The invention is illustrated, merely by way of example, in the following drawings in which.

DESCRIPTION OF THE PREFERRED EMBODIMENT

Figure 1:
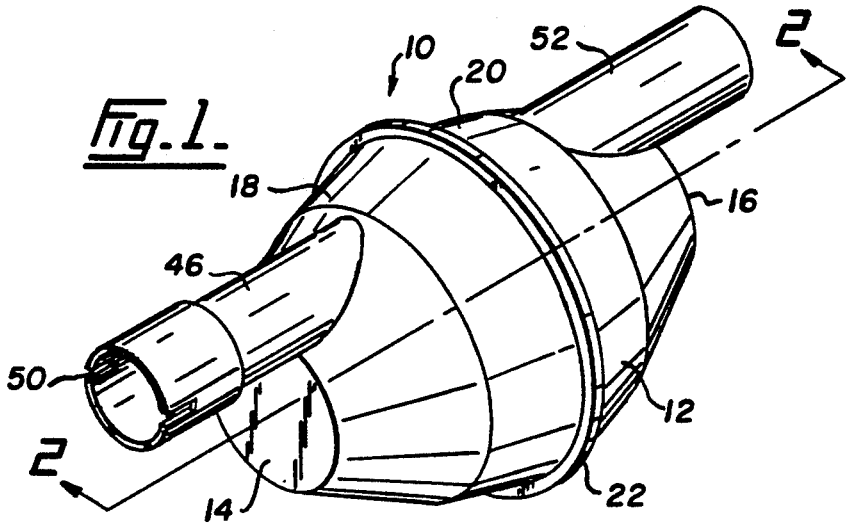
FIG. 1 is a perspective view of a muffler according to the present invention.
Figure 2:
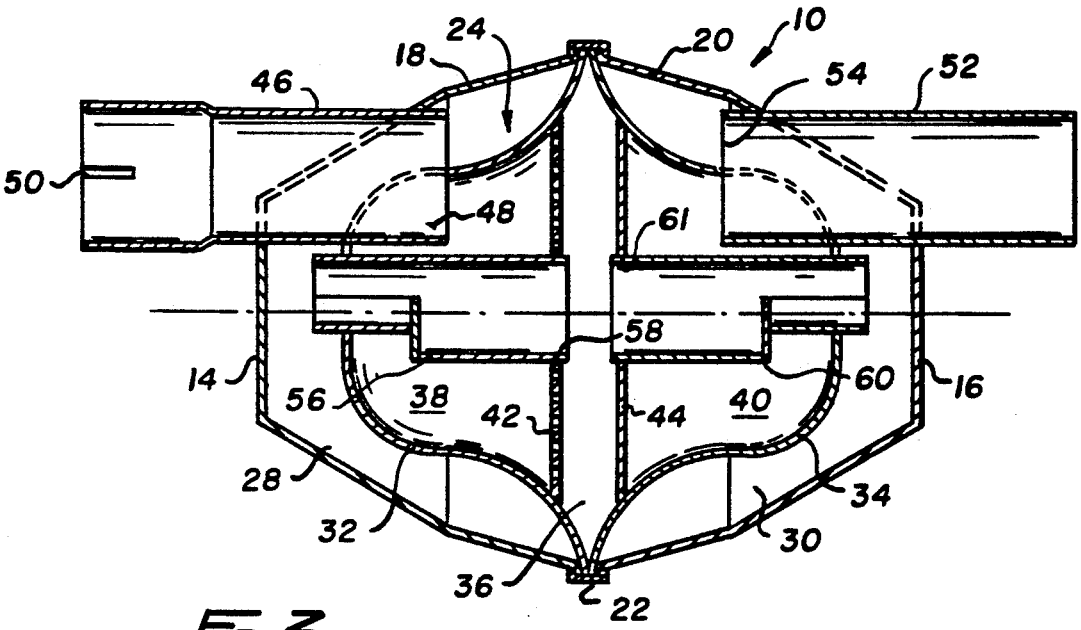
FIG. 2 is a section on the line 2-2 in FIG. 1.

The drawings show a muffler 10 comprising a main body 12 having a downstream end 14 and an upstream end 16 relative to gas flow. The main body comprises two generally truncated cones 18 and 20 joined at an equatorial, or central, seam 22.

There is an inner vessel 24 attached to the inner periphery of the main body 12 to divide the interior of the main body 12 into an inner chamber 26 and first and second outer chambers 28 and 30. The inner vessel 24 again comprises two bodies 32 and 34, each generally bell-shaped and attached at the central seam 22 of the main body 12. There is an empty resonating chamber 36 attached to the interior of inner vessel 24 to divide the inner chamber 26 into first and second inner chambers 38 and 40. The resonating chamber 36 has a perforate wall 42 at its upstream side attached to the bell-shaped body 32 and, except for an opening 61 described below, an imperforate wall 44 on its downstream side, attached to bell-shaped body 34.

There is an inlet pipe 46 extending into the upstream end 14 of the main body 12 and terminating in a downstream end 48 communicating with the first outer chamber 38 and the first inner chamber 38. As is conventional the inlet pipe 46 is widened and formed with a slit 50 at its outer end to attach to an exhaust pipe from an internal combustion engine (not shown). There is an outlet pipe 52 extending into the upstream end of the main body and terminating in a downstream end 54 communicating with the second outer chamber 30 and the second inner chamber 40. The inlet pipe 46 is attached to the inner vessel 24 at a part of the diameter of the pipe. The arrangement is such that the pipe 46 communicates with the first inner vessel 38 and the first outer chamber 28. A similar arrangement is used for the outlet pipe 52 where a downstream end of the outlet pipe, within the main body 12, is attached to the inner vessel on part of the diameter of the pipe 52 so that the pipe 52 communicates with the second inner chamber 40 and with the second outer chamber 30.

There is a first inner pipe 56 wholly within the main body 12 of the muffler and extending from the first outer chamber 28, through the first inner chamber 38 through an opening 58 in the resonating chamber 36 to communicate the first outer chamber 28, the first inner chamber 38 and the resonating chamber 36. Similarly a second inner pipe 60, also wholly within the main body 12, communicates the second outer chamber 30, the second inner chamber 40 and the resonating chamber 36 through an opening 61 in wall 44.

Figure 3:
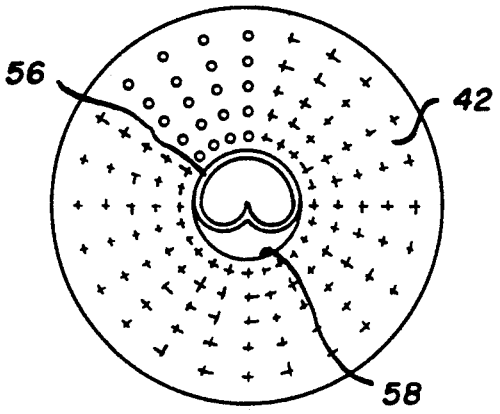
FIG. 3 is a detail of FIG. 2.
Figure 4:
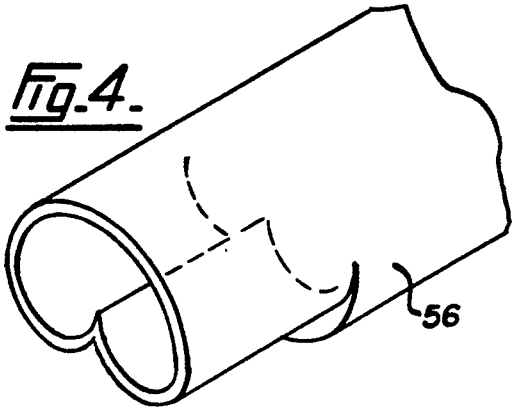
FIG. 4 is a further detail of FIG. 2.

At the ends the first and second inner pipes 56 and are compressed and generally heart-shaped. The heart-shaped ends extend through the walls of the inner vessel to permit communication between the first outer chamber 28, the first inner chamber 38 and the resonating chamber 36 and, in the case of the second pipe 60, to communicate the interior of the resonating chamber 36, the interior of the second inner vessel chamber 40 and the interior of the second outer chamber 30. FIGS. 3 and 4 show the shape that permits this communication. FIG. 3 also show the perforate wall 42 of resonating chamber 36.

The muffler of the present invention may be made of stainless steel, mild steel or aluminised steel. These materials are conventional in the art. The muffler of the invention may be attached in an entirely conventional manner. The light weight and small volume facilitate attachment in an exhaust system. Exhaust gases enter through inlet pipe 46 and are distributed between the first outer chamber 28, the first inner chamber 38 and enters the first inner pipe 56. All gases must pass thorough the resonating chamber 36 and then pass from the resonating chamber 36 to the second inner pipe 60 to second inner chamber 40 and second outer chamber 30. The gases pass through the outlet pipe 52 to leave the muffler.

It should be noted that there is no packing in the resonating chamber 36 or anywhere in the muffler. The muffler has extremely low back pressure which is desirable for fuel economy and for avoiding carbon build-up. The muffler has proved to be extremely efficient and compares well with mufflers twice the size in its ability to muffle noise. The muffler is easy to produce as the inlet and outlet size of the same except for the perforate wall for the resonating chamber. This greatly facilitates production of the device from components.

Accordingly the present invention provides a muffler that is cheap and simple to make and yet is extremely effective in both muffling noise and reducing back pressure of the exhaust system, thus contributing to fuel economy.

Although the forgoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the appended claims.

I claim:

1. A muffler comprising:

a main body having a downstream end and an upstream end relative to gas flow;

an inner vessel attached to the main body to divide the interior of the main body into an inner chamber and first and second outer chambers;

a resonating chamber within the inner chamber to divide the inner chamber into first and second inner chambers;

the resonating chamber having a perforate wall on its upstream side;

an inlet pipe extending into the upstream end of the main body and terminating in a downstream end communicating with the first outer chamber and the first inner chamber;

an outlet pipe extending into the upstream end of the main body and terminating in a downstream end communicating with the second outer chamber and a second inner chamber;

a first inner pipe communicating the first outer chamber, the first inner chamber, and the resonating chamber; and a second inner pipe communicating the second outer chamber, the second inner chamber and the resonating chamber 2. A muffler as claimed in claim 1 in which the main body comprises two generally truncated cones joined at a central seam.

3. A muffler as claimed in claim 1 in which the inner vessel comprises two generally bell-shaped bodies attached at a central seam of the main body.

4. A muffler as claimed in claim 3 in which the resonating chamber is formed by a pair of walls, a perforate wall on the upstream side and, except for an opening for the second inner pipe, an imperforate wall on its downstream side, each wall attached to a bell-shaped body.

5. A muffler as claimed in claim 1 in which the inlet pipe is attached to the inner vessel on part of the diameter of the pipe so that part of the pipe communicates with the first inner chamber and part communicates with the first outer chamber.

6. A muffler as claimed in claim 1 in which the outlet pipe is attached to the inner vessel on part of the diameter of the pipe so that part of the pipe communicates with the second inner vessel and part communicates with the second outer chamber.

7. A muffler as claimed in claim 1 in which the outer ends of the first and second ends of the pipes have compressed to a generally heart shape.

8. A muffler as claimed in claim 7 in which the heart-shaped ends extend through the inner vessel.

* * * * *